US010916212B2

(12) United States Patent
Shimizu

(10) Patent No.: US 10,916,212 B2
(45) Date of Patent: Feb. 9, 2021

(54) DISPLAY DEVICE WITH TWO GATE DRIVE CIRCUITS AND GATE SLOPE FORMING SECTIONS FOR REDUCING DISPLAY UNEVENESS

(71) Applicant: SAKAI DISPLAY PRODUCTS CORPORATION, Sakai (JP)

(72) Inventor: Yoshiyuki Shimizu, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/330,877

(22) PCT Filed: Sep. 6, 2016

(86) PCT No.: PCT/JP2016/076214

§ 371 (c)(1),
(2) Date: Apr. 23, 2019

(87) PCT Pub. No.: WO2018/047244

PCT Pub. Date: Mar. 15, 2018

(65) Prior Publication Data

US 2019/0251922 A1 Aug. 15, 2019

(51) Int. Cl.
*G09G 3/36* (2006.01)
*G09G 3/20* (2006.01)

(52) U.S. Cl.
CPC ..... *G09G 3/3677* (2013.01); *G09G 3/20* (2013.01); *G09G 3/36* (2013.01); *G09G 3/3696* (2013.01);

(Continued)

(58) Field of Classification Search
None
See application file for complete search history.

(56) References Cited

U.S. PATENT DOCUMENTS 7,817,172 B2 10/2010 Hong et al.
9,588,612 B2 3/2017 Okamura
(Continued)

FOREIGN PATENT DOCUMENTS

JP 2008-009364 A 1/2008
JP 2008-129289 A 6/2008
(Continued)

*Primary Examiner* — Amare Mengistu
*Assistant Examiner* — Sarvesh J Nadkarni
(74) *Attorney, Agent, or Firm* — ScienBiziP, P.C.

(57) ABSTRACT

A display device (1) includes a display panel (10), a first gate drive circuit (11), a second gate drive circuit (12), a first gate slope formation unit (21), and a second gate slope formation unit (22). A plurality of pixels (3) is arranged in a matrix in the display panel. A plurality of gate lines (GL) for selecting pixel groups arranged along rows (X) is arranged along columns (Y) in the matrix. The first gate drive circuit supplies each gate line with a first gate drive signal from each end of the plurality of gate lines. The second gate drive circuit supplies each gate line with a second gate drive signal from each opposite end of the plurality of gate lines. The first gate slope formation unit forms a gate slope which is a falling slope in the signal waveform of the first gate drive signal. The second gate slope formation unit forms a gate slope of the second gate drive signal independently of the first gate slope formation unit.

11 Claims, 15 Drawing Sheets

(52) U.S. Cl.
CPC ..... *G09G 2300/0408* (2013.01); *G09G 2320/0233* (2013.01)

(56) References Cited

U.S. PATENT DOCUMENTS

| | | | | |
|---|---|---|---|---|
| 2003/0122765 | A1* | 7/2003 | Yoon | G09G 3/3674 345/94 |
| 2008/0001887 | A1* | 1/2008 | Hong | G09G 3/3677 345/94 |
| 2013/0107152 | A1* | 5/2013 | Okumura | G02F 1/13306 349/41 |
| 2015/0268777 | A1 | 9/2015 | Okamura | |
| 2016/0365060 | A1* | 12/2016 | Yabuki | G09G 3/3696 |

FOREIGN PATENT DOCUMENTS

| | | | |
|---|---|---|---|
| JP | 2015-184313 | A | 10/2015 |
| WO | 2015/128904 | A1 | 9/2015 |

* cited by examiner

DISPLAY DEVICE WITH TWO GATE DRIVE CIRCUITS AND GATE SLOPE FORMING SECTIONS FOR REDUCING DISPLAY UNEVENESS

TECHNICAL FIELD

The present invention relates to a display apparatus including gate drive circuits that drive gate lines for selecting pixels.

BACKGROUND ART

A primary cause of display unevenness in a display apparatus is drawing of charge amounts of pixels by a gate drive signal which drives a gate line. A gate pulse modulation method of modulating a falling signal waveform of a gate drive signal is known as a technique for improving the drawing of the charge amounts of the pixels.

Patent Literature 1 discloses a liquid crystal display apparatus including a circuit for generating a gate pulse modulation signal. The circuit for generating a gate pulse modulation signal disclosed in Patent Literature 1 includes a first gate pulse modulator which modulates a gate drive signal supplied to odd-numbered gate lines and a second gate pulse modulator which modulates a gate drive signal supplied to even-numbered gate lines in the liquid crystal display apparatus. According to Patent Literature 1, the appearance of flicker is reduced when the first and second gate pulse modulators use clock signals each having a different phase on odd-numbered and even-numbered gate lines.

Patent Literature 2 discloses a display apparatus including a slope signal generator. The slope signal generator disclosed in Patent Literature 2 performs signal generation such that a falling signal waveform of a gate drive signal includes a portion inclined from a high-level first voltage to a specific second voltage and a portion inclined from the second voltage to a low-level third voltage. According to Patent Literature 2, display irregularities that may be caused by manufacturing variation are reduced by adjusting the second voltage in the fall of the gate drive signal at the time of manufacturing or the like.

CITATION LIST

Patent Literature

Patent Literature 1: Japanese Patent Application Laid-Open Publication No. 2008-009364

Patent Literature 2: International Patent Publication No. 2015/128904

Patent Literature 3: Japanese Patent Application Laid-Open Publication No. 2015-184313

SUMMARY OF INVENTION

Technical Problem

In some display apparatuses, gate drive circuits for driving gate lines are provided on both sides of the display apparatus. The gate drive circuits may drive the gate lines from both ends of the gate lines (refer to Patent Literature 3, for example).

An object of the present invention is to provide a display apparatus which drives gate lines from both ends thereof and which is capable of reducing display unevenness in the display apparatus.

Solution to Problem

A display apparatus according to the present invention includes a display panel, a first gate drive circuit, a second gate drive circuit, a first gate slope forming section, and a second gate slope forming section. In the display panel, a plurality of pixels are arranged in a matrix, and a plurality of gate lines which each select a pixel group of pixels aligned in a row direction of the matrix are arranged side by side in a column direction of the matrix. The first gate drive circuit supplies a first gate drive signal to each of the plurality of gate lines from one end of each of the plurality of gate lines. The second gate drive circuit supplies a second gate drive signal to each of the plurality of gate lines from an opposite end of each of the plurality of gate lines. The first gate slope forming section forms a gate slope which is a falling slope in a signal waveform of the first gate drive signal. The second gate slope forming section forms a gate slope of the second gate drive signal independently from the first gate slope forming section.

Advantageous Effects of Invention

In the display apparatus according to the present invention, gate slopes of the first and second gate drive signals can be formed independently by the first and second gate slope forming sections. Thus, display unevenness can be reduced in the display apparatus in which the gate lines are driven from both ends thereof.

DESCRIPTION OF EMBODIMENTS

The following describes embodiments of a display apparatus according to the present invention with reference to the accompanying drawings. Similar elements of configuration are labelled with the same reference signs in the following embodiments.

First Embodiment

1. Configuration

Figure 1:
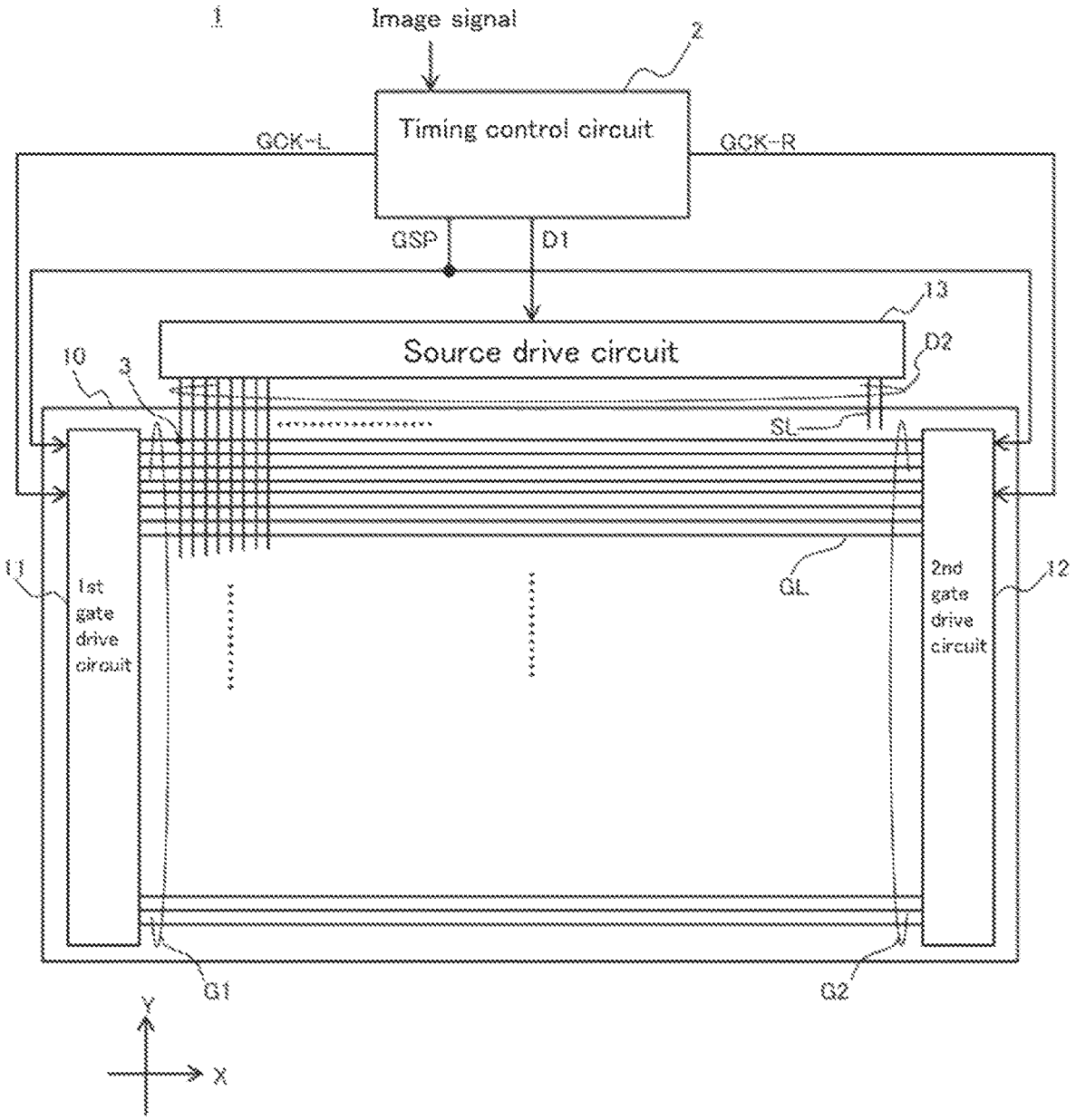
FIG. 1 is a block diagram illustrating a configuration of a display apparatus according to a first embodiment of the present invention.

The following describes a configuration of the display apparatus according to a first embodiment with reference to FIG. 1. FIG. 1 is a block diagram illustrating the configuration of a display apparatus 1 according to the present embodiment.

The display apparatus 1 according to the present embodiment is a gate-in-panel (GIP) type liquid crystal display apparatus, for example. The display apparatus 1 includes a display panel 10, first and second gate drive circuits 11 and 12, a source drive circuit 13, and a timing control circuit 2 as illustrated in FIG. 1.

The display panel 10 is an active-matrix type liquid crystal panel, for example. The display panel 10 includes a plurality of pixels 3, a plurality of gate lines GL, and a plurality of source lines SL ac illustrated in FIG. 1. The display panel 10 also includes such items as a thin-film-transistor (TFT) substrate with pixel electrodes, a color filter (CF) substrate with counter electrodes, a liquid crystal layer enclosed between the TFT substrate and the CF substrate, and a polarizing plate, for example.

The pixels 3 are arranged in a matrix in the display panel 10. The gate lines GL and the source lines SL are arranged so as to correspond respectively to rows and columns in the matrix of the pixels 3. In the following, a row direction of the matrix of the pixels 3 is referred to as an "X direction", and a column direction is referred to as a "Y direction". A positive side in the X direction may also be referred to as a right side, and a negative side may be referred to as a left side.

Each of the pixels 3 includes such an item as a TFT, which is an active element. In the TFT of each pixel 3, a gate is connected to a gate line GL and a source is connected to a source line SL (refer to FIG. 2). A circuit configuration of each pixel 3 is described later.

The gate lines GL are arranged side by side in the Y direction in the display panel 10 as illustrated in FIG. 1. Each gate line GL is a signal line corresponding to a row of the matrix of the pixels 3 and selects a corresponding pixel group of pixels aligned in the X direction.

The source lines SL are arranged side by side in the X direction in the display panel 10. Each source line SL is a signal line corresponding to a column of the matrix of pixels 3 and inputs a signal to corresponding pixels aligned in the Y direction.

In the display apparatus 1 according to the present embodiment, the first and second gate drive circuits 11 and 12 are provided on either end of the gate lines GL. The first and second gate drive circuits 11 and 12 drive each gate line GL from either end of the gate line GL. Also according to the present embodiment, the first and second gate drive circuits 11 and 12 are incorporated into the display panel 10, constituting a GIP-type display panel. The first and second gate drive circuits 11 and 12 include a shift register and an output buffer, for example.

The first gate drive circuit 11 is provided on the left side of the display panel 10 in the X direction as illustrated in FIG. 1. The first gate drive circuit 11 includes TFTs located adjacent to a left edge on the TFT substrate of the display panel 10. The first gate drive circuit 11 supplies a first gate drive signal G1 from a left end of each gate line GL under the control of the timing control circuit 2. The first gate drive signal G1 is a signal which drives the gate lines GL while scanning the gate lines GL.

The second gate drive circuit 12 is provided on the right side of the display panel 10 in the X direction, and includes TFTs located adjacent to a right edge on the TFT substrate of the display panel 10. The second gate drive circuit 12 supplies a second gate drive signal G2 from a right end of each gate line GL under the control of the timing control circuit 2. The second gate drive signal G2 is a signal which drives the gate lines GL while scanning the gate lines GL at the same time as the first gate drive signal G1.

The source lines SL are connected to the source drive circuit 13. The source drive circuit 13 supplies a source drive signal D2 to each source line SL synchronously with the scanning of the gate lines GL under the control of the timing control circuit 2. The source drive signal D2 is a signal which drives the source lines SL in parallel to write image data to a pixel group selected in the scanning of the gate lines GL.

The timing control circuit 2 is a circuit which generates various signals to control operation timing of each section of the display apparatus 1. The timing control circuit 2 is configured as one or more semiconductor integrated circuits such as those produced by large-scale integration (LSI), for example. The timing control circuit 2 may control overall operation of the display apparatus 1. A configuration of the timing control circuit 2 is described later in detail.

For example, the timing control circuit 2 generates a control signal D1 according to an image signal input from an external source to write the image data of each column in an image of a frame unit indicated by the image signal. The timing control circuit 2 also generates items such as a start timing signal GSP, and first and second gate signals GCK-L and GCK-R. The start timing signal GSP is a timing control signal indicating a timing at which one frame of the image is started. The first and second gate signals GCK-L and GCK-R are control signals which respectively control scan driving by the first and second gate drive circuits 11 and 12.

1-1. Pixel Circuit Configuration

Figure 2:
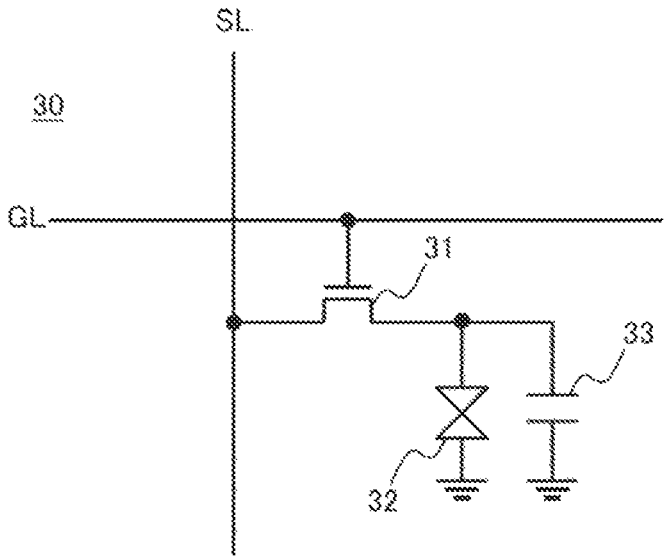
FIG. 2 is a circuit diagram illustrating a pixel circuit in the display apparatus.

The following describes the circuit configuration of each pixel 3 in the display panel 10 with reference to FIG. 2. FIG. 2 is a circuit diagram illustrating a pixel circuit 30 in the display apparatus 1. Each pixel 3 in the display panel 10 includes an equivalent pixel circuit 30. The pixel circuit 30 includes a TFT 31, a pixel capacitor 32, and a storage capacitor 33 as illustrated in FIG. 2.

In the TFT 31 of the pixel circuit 30, a gate is connected to a gate line GL, a source is connected to a source line SL, and a drain is connected to an end of the pixel capacitor 32 and an end of the storage capacitor 33. An opposite end of the pixel capacitor 32 and an opposite end of the storage capacitor 33 are grounded to a counter electrode in the display panel 10, for example.

The TFT 31 turns on when voltage applied to the gate through the gate line GL is at least a specific threshold voltage, and turns off when the voltage is less than the threshold voltage. The threshold voltage of the TFT 31 is 2 to 3 V, for example.

The pixel capacitor 32 includes a liquid crystal layer and a pixel electrode, and changes an orientation state of the liquid crystal layer according to a charge amount. The pixel capacitor 32 charges or discharges based on voltage of a signal input from the source line SL while the TFT 31 is on. While the TFT 31 is off, the pixel capacitor 32 holds the charge amount obtained by charging and discharging before the TFT 31 is switched off.

The storage capacitor 33 is a capacitive element for preventing attenuation of the charge amount (charge voltage) held by the pixel capacitor 32. The storage capacitor 33 charges and discharges at the same timing as the pixel capacitor 32 charges and discharges.

According to the pixel circuit 30, the pixel capacitor 32 can charge and discharge and the pixel circuit 30 can be selected as a writing target of the image data when voltage that is at least the threshold voltage of the TFT 31 is applied from both ends of the gate line GL by the first and second gate drive signals G1 and G2 (FIG. 1). The source drive signal D2 is input to the selected pixel circuit 30. Thus, a charge amount for displaying a corresponding pixel in the image data is charged and discharged, and the image data is written.

1-2. Timing Control Circuit Configuration

Figure 3:
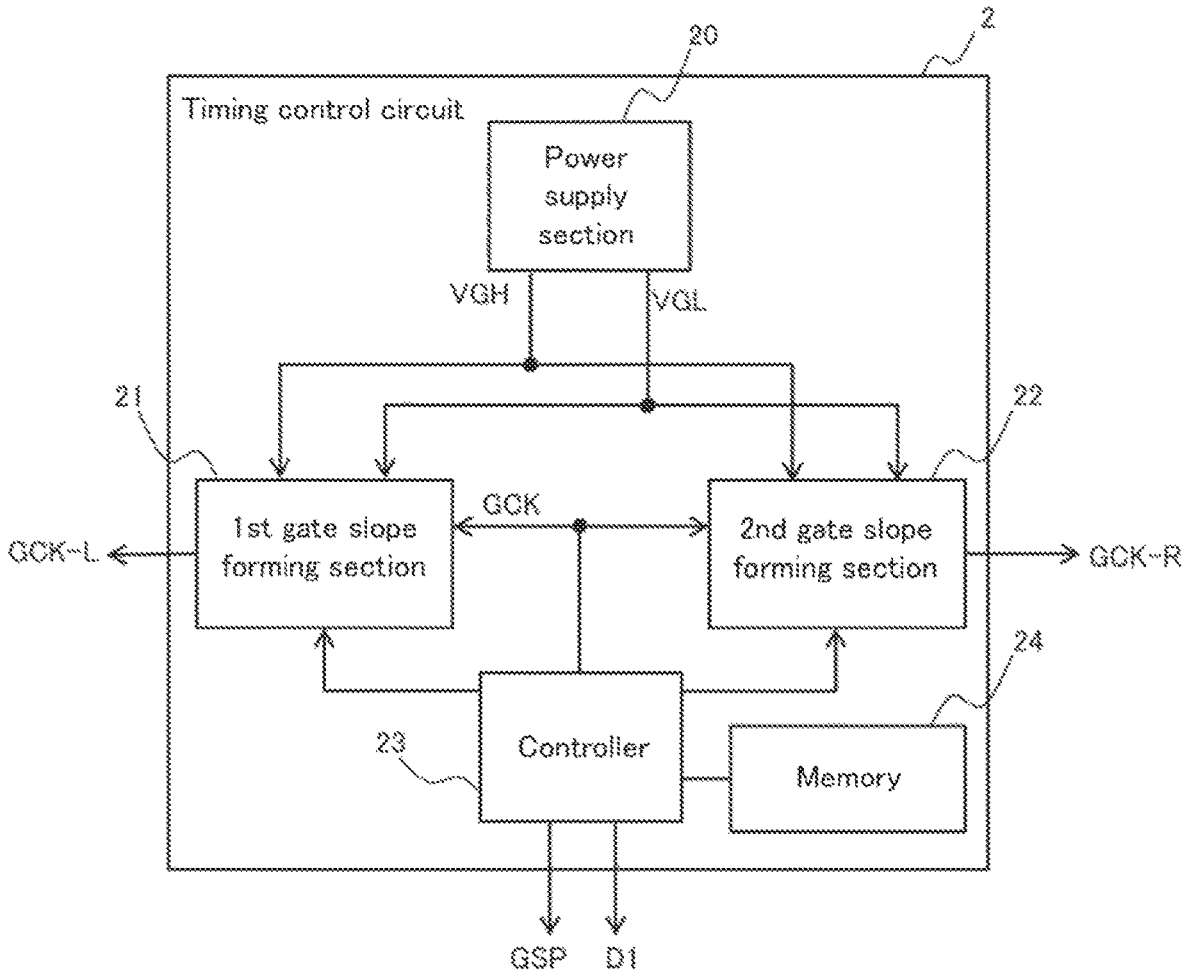
FIG. 3 is a block diagram illustrating a configuration of a timing control circuit in the display apparatus.
Figure 4:
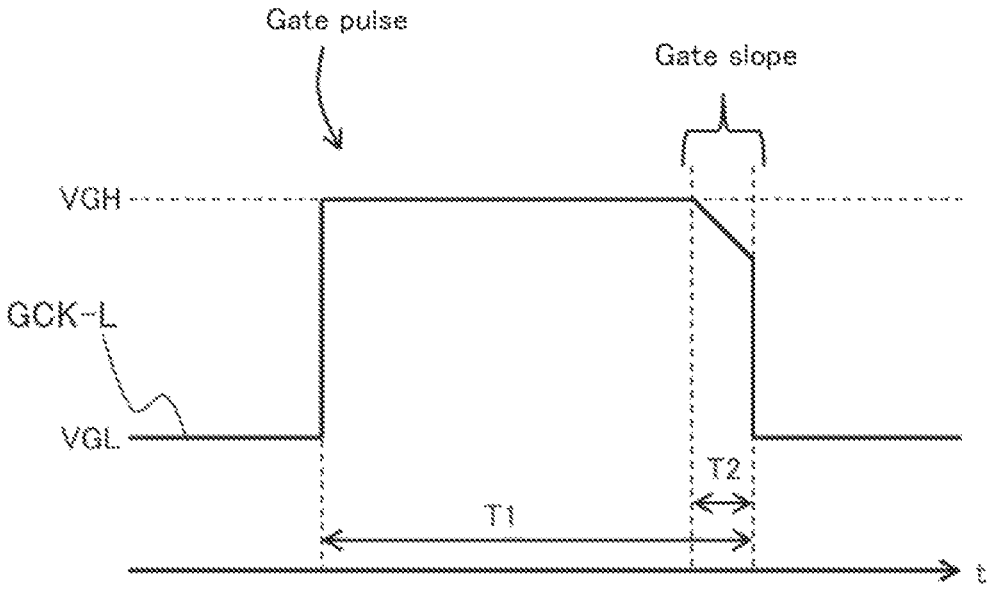
FIG. 4 is a diagram for describing a gate pulse and a gate slope.

The following describes the configuration of the timing control circuit 2 in detail with reference to FIGS. 3 and 4.

FIG. 3 is a block diagram illustrating the configuration of the timing control circuit 2 in the display apparatus 1. The timing control circuit 2 includes a power supply section 20, first and second gate slope forming sections 21 and 22, a controller 23, and memory 24 as illustrated in FIG. 3.

The power supply section 20 includes a voltage source which generates a gate-on voltage VGH and a voltage source which generates a gate-off voltage VGL, for example. The gate-on voltage VGH is a constant voltage greater than the threshold voltage of the TFTs of the display panel 10, and is set to a DC voltage of 20 to 35 V, for example. The gate-off voltage VGL is a constant voltage smaller than the threshold voltage of the TFTs of the display panel 10, and is set to a DC voltage of −10 to −6 V, for example.

The first gate slope forming section 21 generates the first gate signal GCK-L under the control of the controller 23 according to the gate-on voltage VGH and the gate-off voltage VGL from the power supply section 20. The first gate slope forming section 21 then forms a gate slope of a gate pulse included in the first gate signal GCK-L. The gate pulse and the gate slope are described with reference to FIG. 4.

FIG. 4 illustrates an example of a signal waveform of the first gate signal GCK-L. The gate pulse is a pulse voltage applied to the gate of the TFT 31 through the gate line GL to charge and discharge to a desired charge amount in the pixel circuit 30 (FIG. 2) selected as the writing target of the image data. A pulse width T1 of the gate pulse corresponds to a period in which the pixel circuit 30 is selected.

As illustrated in FIG. 4, the signal waveform falling from a high level of the gate-on voltage VGH to a low level of the gate-off voltage VGL in the gate pulse is formed in a slope shape. The gate slope is a falling slope in the signal waveform of the gate pulse. According to the first gate slope forming section 21, items such as a slope width T2, which is the duration of the gate slope, and the inclination of the gate slope are set in the first gate signal GCK-L.

Returning to FIG. 3, the second gate slope forming section 22 generates the second gate signal GCK-R in the same manner as the first gate slope forming section 21. The second gate slope forming section 22 then forms a gate slope of a gate pulse included in the second gate signal GCK-R separately from the setting of the gate slope by the first gate slope forming section 21.

According to the present embodiment, the gate slope of the first gate drive signal G1 and the gate slope of the second gate drive signal G2 are independently formed by the first and second gate slope forming sections 21 and 22. The first and second gate slope forming sections 21 and 22 may be configured as separate integrated circuits, or may be integrated on a single chip. A configuration of the first and second gate slope forming sections 21 and 22 is described later in detail.

The controller 23 controls overall operation of the timing control circuit 2. The controller 23 includes for example a microprocessor unit (MPU) or a central processing unit (CPU) which implements specific functions in cooperation with software. The controller 23 reads out data or programs stored in the memory 24 to perform various calculation processes and generate various signals.

For example, the controller 23 generates the start timing signal GSP, the control signal D1, and a clock signal GCK. The clock signal GCK is a clock signal which defines the cycle of the gate pulse in the first and second gate signals GCK-L and GCK-R. The controller 23 also refers to information stored in the memory 24 to generate various control signals to control the gate slopes to be formed by the first and second gate slope forming sections 21 and 22.

Note that the controller 23 may be a hardware circuit such as a dedicated electronic circuit designed to implement the specific functions or a reconfigurable electronic circuit. The controller 23 may include various semiconductor integrated circuits such as a CPU, an MPU, a microcomputer, a digital signal processor (DSP), a field-programmable gate array (FPGA), or an application-specific integrated circuit (ASIC).

The memory 24 is a storage medium which stores programs and data necessary for implementing the functions of the timing control circuit 2. The memory 24 is for example flash read-only memory (ROM), and is configured to be externally writable at the time of manufacturing or shipping or the like.

For example, the memory 24 stores various firmware. The memory 24 also stores various information setting items such as the slope width and the inclination of the gate slopes formed respectively by the first and second gate slope forming sections 21 and 22. The memory 24 may be divided into multiple parts, and may be configured as a partially or completely separate unit from the timing control circuit 2.

1-3. First and Second Gate Slope Forming Section Configuration

Figure 5:
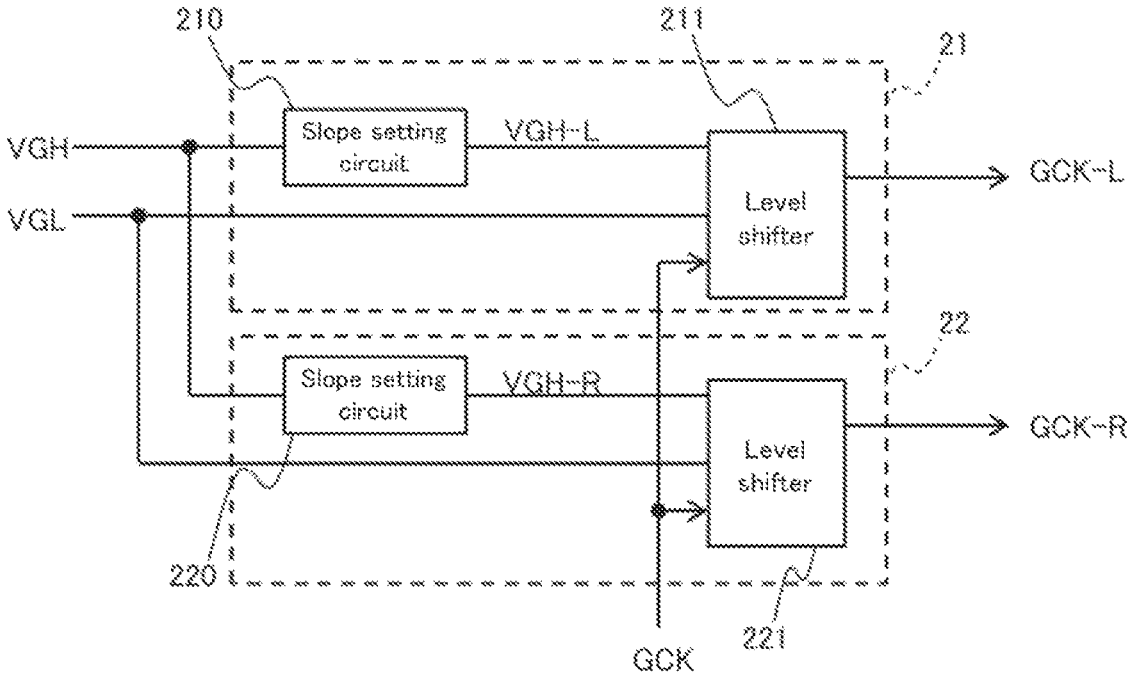
FIG. 5 is a block diagram illustrating a configuration of first and second gate slope forming sections.
Figure 6:
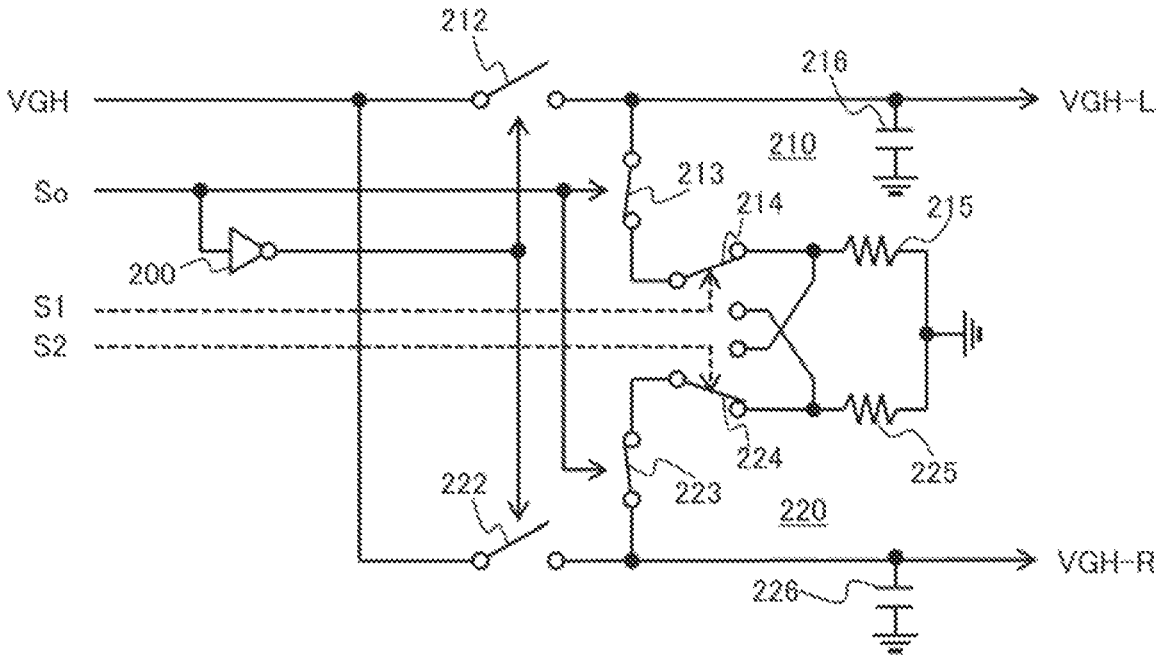
FIG. 6 is a circuit diagram illustrating a slope setting circuit of the first and second gate slope forming sections.

The following describes the configuration of the first and second gate slope forming sections 21 and 22 according to the present embodiment in detail with reference to FIGS. 5 and 6.

FIG. 5 is a block diagram illustrating the configuration of the first and second gate slope forming sections 21 and 22. As illustrated in FIG. 5, the first gate slope forming section 21 includes a slope setting circuit 210 and a level shifter 211. The second gate slope forming section 22 includes a slope setting circuit 220 and a level shifter 221.

The gate-on voltage VGH from the power supply section 20 (FIG. 3) is supplied to the respective slope setting circuits 210 and 220 of the first and second gate slope forming sections 21 and 22. The gate-off voltage VGL from the power supply section 20 is supplied to the respective level shifters 211 and 221 of the first and second gate slope forming sections 21 and 22. The clock signal GCK from the controller 23 is input to the level shifters 211 and 221.

The first gate slope forming section 21 modulates the gate-on voltage VGH in the slope setting circuit 210 cyclically, for example, and generates a first gate slope voltage VGH-L. The first gate slope voltage VGH-L is a voltage with a falling slope shape corresponding to the gate slope of the first gate signal GCK-L from the gate-on voltage VGH (refer to FIG. 8).

The second gate slope forming section 22 modulates the gate-on voltage VGH in the slope setting circuit 220 cyclically, for example, and generates a second gate slope voltage VGH-R. The second gate slope voltage VGH-R is a voltage with a falling slope shape corresponding to the gate slope of the second gate signal GCK-R from the gate-on voltage VGH (refer to FIG. 8).

The following describes an example configuration of the slope setting circuits 210 and 220 of the first and second gate slope forming sections 21 and 22 with reference to FIG. 6. FIG. 6 is a circuit diagram illustrating an example of the slope setting circuits 210 and 220 of the first and second gate slope forming sections 21 and 22.

In the example illustrated in FIG. 6, the slope setting circuit 210 of the first gate slope forming section 21 includes a charge switch 212, a discharge switch 213, a selection switch 214, a resistor 5, and a capacitor 216. The charge switch 212 is connected to the capacitor 216. The discharge switch 213 is connected in between the charge switch 212 and the selection switch 214.

The slope setting circuit 220 of the second gate slope forming section 22 includes a charge switch 222, a discharge switch 223, a selection switch 224, a resistor 225, and a capacitor 226. The charge switch 222 is connected to the capacitor 226. The discharge switch 223 is connected in between the charge switch 222 and the selection switch 224.

According to the present embodiment, the resistors 215 and 225 included respectively in the two slope setting circuits 210 and 220 are interchangeable by switching the selection switches 214 and 224. The resistors 215 and 225 have different resistance values from each other. The two selection switches 214 and 224 select a resistor from the resistors 215 and 225 through control signals S1 and S2 from the controller 23 (FIG. 3). Thus, the resistors 215 and 225 selected by the selection switches 214 and 224 and the capacitors 216 and 226 respectively constitute resistor-capacitor (RC) circuits in the two slope setting circuits 210 and 220. Note that an example in which the two resistors 215 and 225 are selection targets is illustrated in FIG. 6, but three or more resistors may be provided as selection targets.

Also according to the present embodiment, the two charge switches 212 and 222 are linked by a control signal So generated by the controller 23. At the same time, the two discharge switches 213 and 223 are linked. The control signal So from the controller 23 is input to the discharge switches 213 and 223, and input to the charge switches 212 and 222 through an inverter 200. Thus, the control signal So alternately turns the charge switches 212 and 222 and the discharge switches 213 and 223 on and off.

The gate-on voltage VGH from the power supply section 20 is applied to the capacitors 216 and 226 through the charge switches 212 and 222. When the charge switches 212 and 222 are on and the discharge switches 213 and 223 are off, the gate-on voltage VGH is output as the first and second gate slope voltages VGH-L and VGH-R according to the charge of the capacitors 216 and 226. By contrast, when the charge switches 212 and 222 are off and the discharge switches 213 and 223 are on, the charge charged to the capacitors 216 and 226 is discharged through the resistors 215 and 225 selected by the selection switches 214 and 224.

Thus, the first and second gate slope voltages VGH-L and VGH-R are generated based on a time constant of the RC circuits in which the inclination of the falling slope shape has been set in each of the slope setting circuits 210 and 220.

Returning to FIG. 5, the first and second gate slope voltages VGH-L and VGH-R are output to the level shifters 211 and 221 from the slope setting circuits 210 and 220 in the respective first and second gate slope forming sections 21 and 22. The level shifters 211 and 221 are each configured as amplifier circuits including complimentary metal-oxide-semiconductor (CMOS) transistors, for example.

The level shifter 211 of the first gate slope forming section 21 amplifies the high level of the clock signal GCK based on the first gate slope voltage VGH-L, and amplifies the low level of the clock signal GCK based on the gate-off voltage VGL. Thus, the first gate signal GCK-L is generated.

The level shifter 221 of the second gate slope forming section 22 amplifies the high level of the clock signal GCK based on the second gate slope voltage VGH-R, and amplifies the low level of the clock signal GCK based on the gate-off voltage VGL. Thus, the second gate signal GCK-R is generated, 2. Operation The following describes the operation of the display apparatus 1 configured as above.

2-1. Finding Related to Display Unevenness

First, a finding of the present inventors is described as a summary of the operation of the display apparatus 1 according to the present embodiment. The present inventors performed intensive studies of display unevenness in the display apparatus 1 in which the gate lines GL are driven from both ends thereof. As a result, the present inventors discovered a problem of charge amounts among pixels being difficult to equalize using a normal gate pulse modulation method, particularly in the GIP-type display panel 10. The present inventors then obtained an idea for solving the problem. This finding of the present inventors is described as follows with reference to FIGS. 7A and 7B.

Figure 7A:
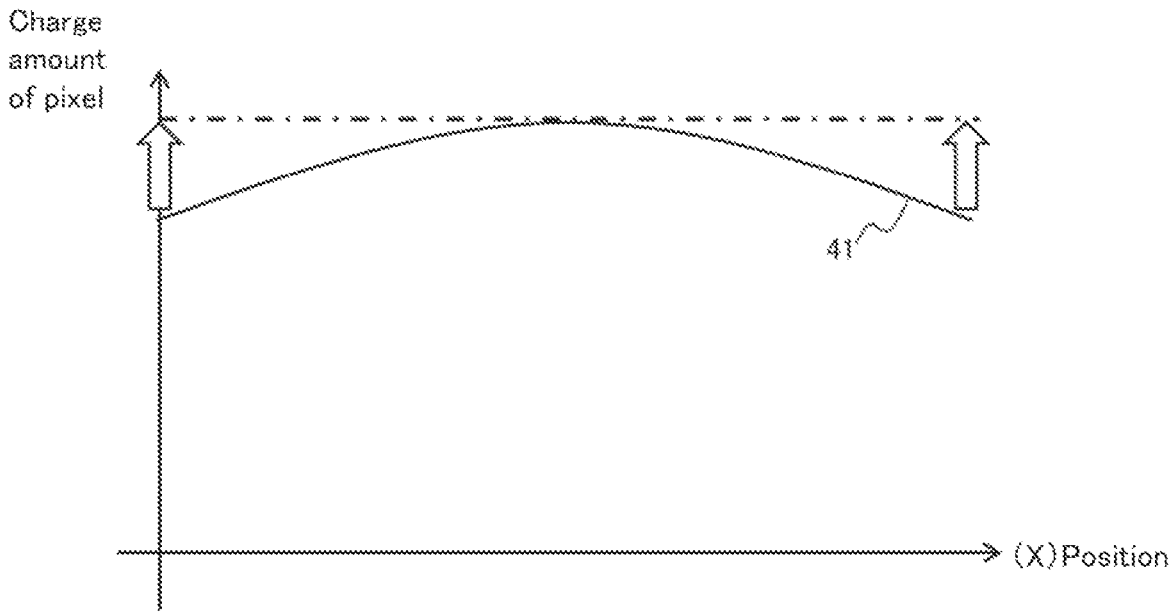
FIGS. 7A and 7B are diagrams for describing a finding related to display unevenness in a display apparatus.

FIGS. 7A and B are graphs showing a distribution of charge amounts among pixels in display panels differing from each other. In FIGS. 7A and B, a horizontal axis represents pixel position on the display panel in the X direction, and a vertical axis represents charge amount (charge voltage of a pixel capacitor) of each pixel.

FIG. 7A illustrates an example in which unevenness in the charge amounts among the pixels in the display panel can be reduced by the normal slope modulation method. For example, a situation is assumed in which gate drive circuits provided on either edge of the display panel maintain desired drivability through CMOS transistors or the like.

The charge amount charged to the pixel supplied with a gate pulse is drawn according to a fall of the gate pulse. The drawing of the charge amount of the pixel in such a manner is a primary cause of display unevenness. The amount drawn from the charge amount of the pixel changes according to a difference in voltage before and after the fail of the gate pulse.

A curve 41 in FIG. 7A indicates the charge amounts among the pixels before the setting of the gate slope. Before the gate slope is set, the gate pulse in a rectangular signal waveform is input to both ends of a gate line. Therefore, the difference in voltage before and after the fall of the gate pulse becomes approximately (VGH-VGL) in the vicinity of either end of the gate line (refer to FIG. 4), and becomes smaller due to dulling of the signal waveform toward the center of the gate line from either end of the gate line.

Consequently, it is thought that the drawing amount of each pixel is smallest in a pixel at or in the vicinity of the center and increases in proportion to (VGH-VGL) in the pixels at either end in the above display panel. That is, as illustrated in FIG. 7A, it is thought that the curve 41 indicating the charge amounts among the pixels becomes symmetrical from left to right.

In the above situation, the gate slope is set according to for example the fall of the signal waveform that has dulled in the center of the gate line upon applying the normal gate pulse modulation method, and a gate pulse with the same waveform as the set gate slope is supplied from gate drive circuits on either side. Thus, it is thought that influence of the drawing of the charge amount of the pixels at either end of the display panel can be improved to the same degree as the pixels at the center, and the charge amounts among the pixels can be equalized as indicated by a dashed line in FIG. 7A.

Figure 7B:
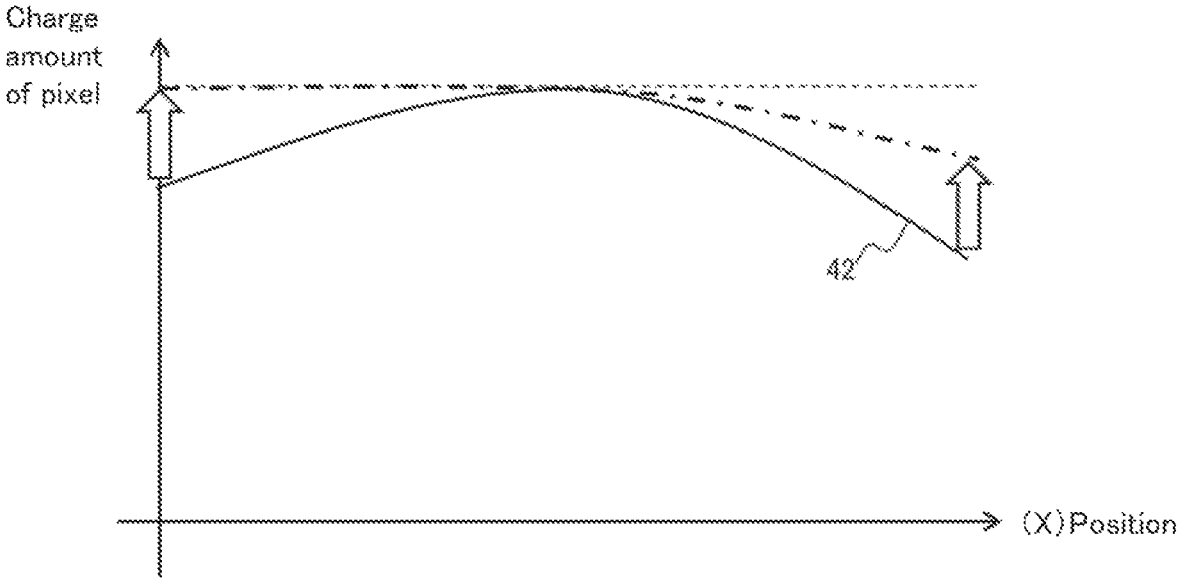

FIG. 7B illustrates an example in which unevenness in the charge amounts among the pixels becomes difficult to address with a normal gate slope modulation method as described above. For example, the GIP-type display panel 10 is assumed. As indicated by a dotted line in FIG. 7B, the charge amounts among the pixels are preferably equalized to a constant level across the left and right of the display panel 10. However, even when applying the normal gate slope modulation method to the charge amounts among the pixels before setting the gate slope as indicated by a curve 42, the charge amounts become inconstant as indicated by a dashed line in FIG. 7B.

The present inventors noticed that a situation such as in FIG. 7B occurs due to characteristic variation among the TFTs depending on a position in the GIP-type display panel 10. That is, the present inventors noticed that the drawing amount in the left and right of the display panel 10 changes due to drivability unevenness of the gate drive circuits 11 and 12 including the TFTs on either side of the display panel 10, and the curve 42 indicating the charge amounts among the pixels becomes asymmetrical from left to right.

The present inventors conducted intensive studies to solve the above difficulty, and arrived at an idea of separately forming the gate slopes of the gate pulses supplied from either end of the gate line GL through the first and second gate slope forming sections 21 and 22 of the display apparatus 1 according to the present embodiment. The following describes the operation of the display apparatus 1 in detail according to the present embodiment.

2-2. Overall Display Apparatus Operation

The following describes the overall operation of the display apparatus 1 according to the present embodiment with reference to FIGS. 1 to 6.

In the timing control circuit 2 (FIG. 3) of the display apparatus 1, the controller 23 generates the control signal D1 indicating the image data of each frame based on the image signal from the external source, and outputs the control signal D1 to the source drive circuit 13. The controller 23 then outputs the start timing signal GSP indicating a start timing of each frame to the first and second gate drive circuits 11 and 12.

The controller 23 also outputs the clock signal GCK to the first and second gate slope forming sections 21 and 22. The controller 23 additionally refers to the information stored in the memory 24 to generate the control signal So that sets the slope width T2 and the control signals S1 and S2 (FIG. 6) that set each of the slope setting circuits 210 and 220, and outputs the control signals So, S1, and S2 to the first and second gate slope forming sections 21 and 22.

The first gate slope forming section 21 generates the first gate signal GCK-L so as to form a gate slope based on the control signals So and S1 in the gate pulse of the cycle according to the clock signal GCK, and outputs the first gate signal GCK-L to the first gate drive circuit 11. The second gate slope forming section 22 generates the second gate signal GCK-R so as to form a gate slope based on the control signals So and S2 in the gate pulse of the cycle according to the clock signal GCK, and outputs the second gate signal GCK-R to the second gate drive circuit 12. Operation of the first and second gate slope forming sections 21 and 22 is described later in detail.

The first gate drive circuit 11 (FIG. 1) starts the scan driving of the gate lines GL through the first gate drive signal G1 from a timing indicated by the start timing signal GSP according to the start timing signal GSP from the timing control circuit 2.

The first gate drive circuit 11 generates the first gate drive signal G1 so as to include one gate pulse for each gate line GL according to the gate pulse in the first gate signal GCK-L from the timing control circuit 2. Thus, the first gate drive signal G1 including the gate pulse is sequentially supplied to each gate line GL from the left end thereof, and the scan driving is performed to select the pixels 3 of one row connected to the gate line GL in order.

The second gate drive circuit 12 starts the scan driving of the gate lines GL through the second gate drive signal G2 at the same timing as the scan driving by the first gate drive circuit 11 according to the start timing signal GSP from the timing control circuit 2.

The second gate drive circuit 12 generates the second gate drive signal G2 so as to include one gate pulse for each gate line GL according to the gate pulse in the second gate signal GCK-R from the timing control circuit 2. Thus, the second gate drive signal G2 including the gate pulse is sequentially supplied to each gate line GL from the right end thereof, and the scan driving is performed by the second gate drive circuit 12 at the same time as the scan driving by the first gate drive circuit 11.

The source drive circuit 13 outputs the source drive signal D2 including write information to the pixels 3 of one selected row in synchronization with the scan driving of the gate lines GL by the first and second gate drive circuits 11 and 12 based on the control signal D1 from the timing control circuit 2. Thus, parallel driving of the source lines SL that write to the pixels 3 in the respective rows in the image data of one frame is performed.

According to the above operation, the gate slope of the first gate drive signal G1 supplied from the left end of a gate line GL in the scan driving by the first gate drive circuit 11 is formed by the first gate slope forming section 21. By contrast, the gate slope of the second gate drive signal G2 supplied from the right end of the gate line GL in the scan driving by the second gate drive circuit 12 is formed by the second gate slope forming section 22 separately from the gate slope of the first gate drive signal G1. Thus, the gate slopes of the gate pulses supplied from either end of the gate line GL are formed separately, and display unevenness can be reduced among the pixels 3 across both ends of each gate line GL.

2-3. First and Second Gate Slope Forming Section Operation

Figure 8:
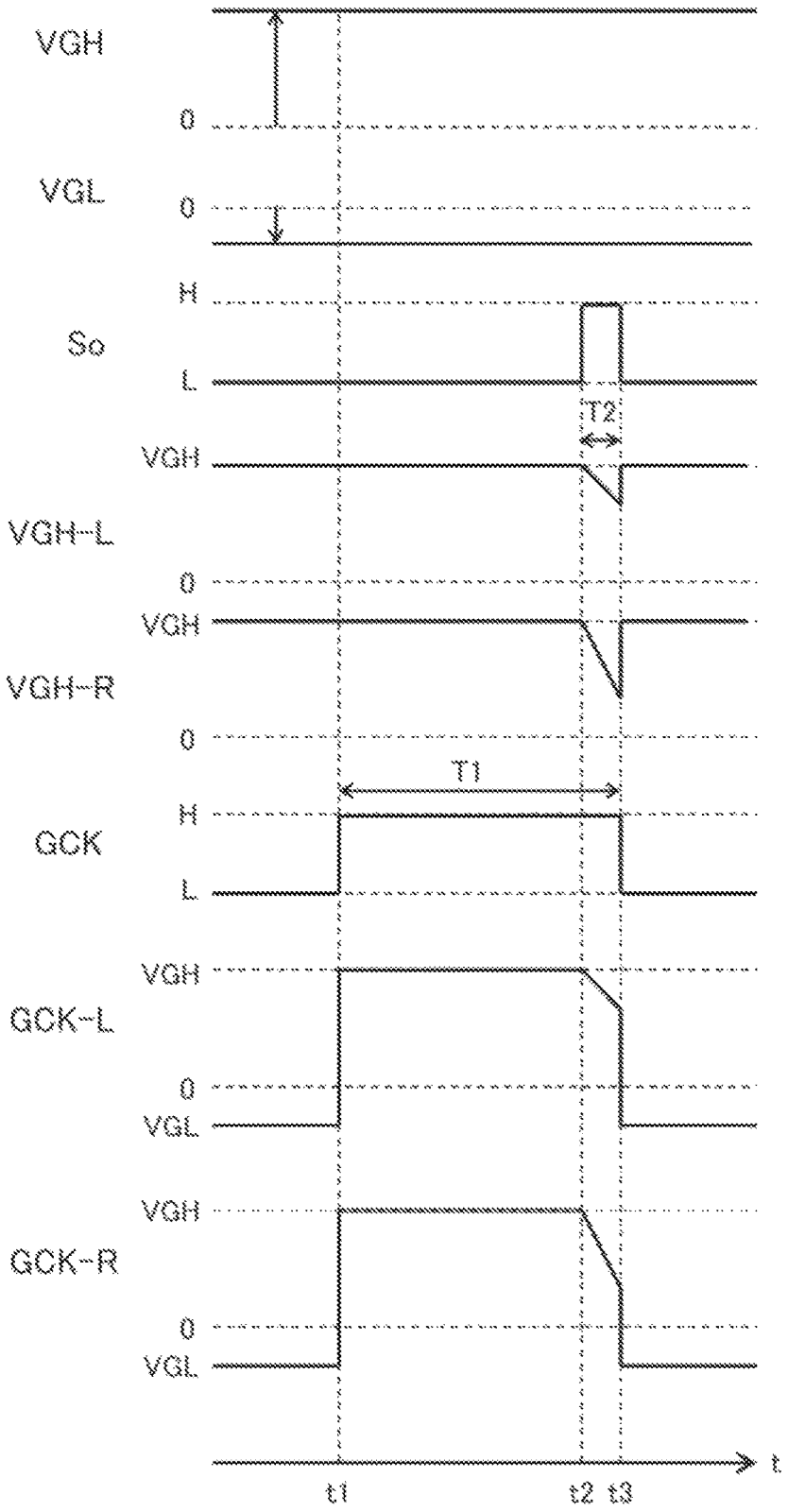
FIG. 8 is a timing diagram of various signals illustrating operation timing of the first and second gate slope forming sections.

The following describes the operation of the first and second gate slope forming sections 21 and 22 in detail with reference to FIG. 8.

VGH and VGL in FIG. 8 respectively illustrate a supply timing of the gate-on voltage VGH and the gate-off voltage VGL. So in FIG. 8 illustrates a control timing of the control signal So. VGH-L and VGH-R in FIG. 8 respectively illustrate a generation timing of the first and second gate slope voltages VGH-L and VGH-R. GCK in FIG. 8 illustrates an input timing of the clock signal GCK. GCK-L and GCK-R in FIG. 8 respectively illustrate an output timing of the first and second gate signals GCK-L and GCK-R.

In FIG. 8, a reference potential "0" is for example the potential of a counter electrode of the display panel 10. Also, a high level "H" in FIG. 8 is a signal level at a specific voltage (3.3 V, for example), and a low level "L" is a signal level at a specific voltage (0 V, for example) lower than the high level "H".

The gate-on voltage VGH from the power supply section 20 (FIG. 3) is supplied to each of the slope setting circuits 210 and 220 in the first and second gate slope forming sections 21 and 22 at a voltage level greater than the reference potential as illustrated in FIG. 8.

The gate-off voltage VGL from the power supply section 20 is supplied to the respective level shifters 211 and 221 of the first and second gate slope forming sections 21 and 22 at a voltage level smaller than the reference potential as illustrated in FIG. 8.

The clock signal GCK is supplied from the controller 23 to the respective level shifters 211 and 221 of the first and second gate slope forming sections 21 and 22. The clock signal GCK has a rectangular signal waveform as illustrated in FIG. 8, and has a specific signal amplitude (3.3 V, for example). The clock signal GCK rises at a time t1 and falls at a time t3 in FIG. 8. The time t3 is after a period T1 (pulse width) from the time t1.

The control signal So from the controller 23 (FIG. 3) is at a low level from the time t1 to a time t2 as illustrated in FIG. 8. At this time, the charge switches 212 and 222 are switched on and the discharge switches 213 and 223 are switched off in the slope setting circuits 210 and 220 illustrated in FIG. 6. Thus, the first and second gate slope voltages VGH-L and VGH-R become a constant voltage at the same voltage level as the gate-on voltage VGH until the time t2 as illustrated in FIG. 8.

The time t2 is a time preceding the time t3 by the slope width T2, the time t3 being after the period T1 from the time t1. The controller 23 (FIG. 3) refers to the slope width T2 stored in the memory 24 and switches the control signal So to a high level from the time t2 to the time t3 as illustrated in FIG. 8. Thus, the discharge switches 213 and 223 are on and the charge switches 212 and 222 are off in a period T2 from the time t2 to the time t3.

The first gate slope voltage VGH-L then falls in a slope shape in the period T2 between the times t2 and t3 as illustrated in FIG. 8. The falling inclination in the first gate slope voltage VGH-L is set according to a time constant based on the preselected resistor 215 at the selection switch 214 (FIG. 6) of the slope setting circuit 210. The first gate slope voltage VGH-L is output to the level shifter 211 from the slope setting circuit 210 in the first gate slope forming section 21 (refer to FIG. 5).

The level shifter 211 of the first gate slope forming section 21 outputs the first gate signal GCK-L (GCK-L in FIG. 8) at the signal level of the gate-off voltage VGL (VGL in FIG. 8) according to the low-level clock signal GCK (GCK in FIG. 8) before the time t1 and after the time t3. By contrast, the level shifter 211 outputs the first gate signal GCK-L at the signal level of the first gate slope voltage VGH-L (VGH-L in FIG. 8) according to the high-level clock signal GCK (GCK in FIG. 8) in the period T1 between the times t1 and t3. Thus, the gate slope of the period T2 in the first gate signal GCK-L is formed by the fall in the first gate slope voltage VGH-L (VGH-L and GCK-L in FIG. 8).

The second gate slope voltage VGH-R then falls in a slope shape in the period T2 between the times t2 and t3 as illustrated in FIG. 8. The falling inclination in the second gate slope voltage VGH-R is set by the slope setting circuit 220 separately from the slope setting circuit 210 which sets the inclination of the first gate slope voltage VGH-L (refer to FIG. 5). The second gate slope voltage VGH-R is output to the level shifter 221 from the slope setting circuit 220 in the second gate slope forming section 22.

The level shifter 221 of the second gate slope forming section 22 outputs the second gate signal GCK-R (GCK-R in FIG. 8) at the signal level of the gate-off voltage VGL (VGL in FIG. 8) in the same manner as the first gate signal GCK-L before the time t1 and after the time t3. By contrast, the level shifter 221 outputs the second gate signal GCK-R at the signal level of the second gate slope voltage VGH-R (GCK-R in FIG. 8) separately from the first gate slope voltage VGH-L (GCK-L in FIG. 8) in the period from the time t1 to the time t3. Thus, the gate slope in the second gate signal GCK-R is formed by the fall in the second gate slope voltage VGH-R independently of the gate slope in the first gate signal GCK-L (VGH-R and GCK-R in FIG. 8).

According to the operation of the first and second gate slope forming sections 21 and 22 described above, the respective gate slopes in the first and second gate signals GCK-L and GCK-R can be formed independently of each other.

Also in the first and second gate slope forming sections 21 and 22, the inclination and the like of the respective gate slopes of the first and second gate signals GCK-L and GCK-R are preset in the slope setting circuits 210 and 220. The following describes a setting method of the gate slopes with reference to FIG. 9.

Figure 9:
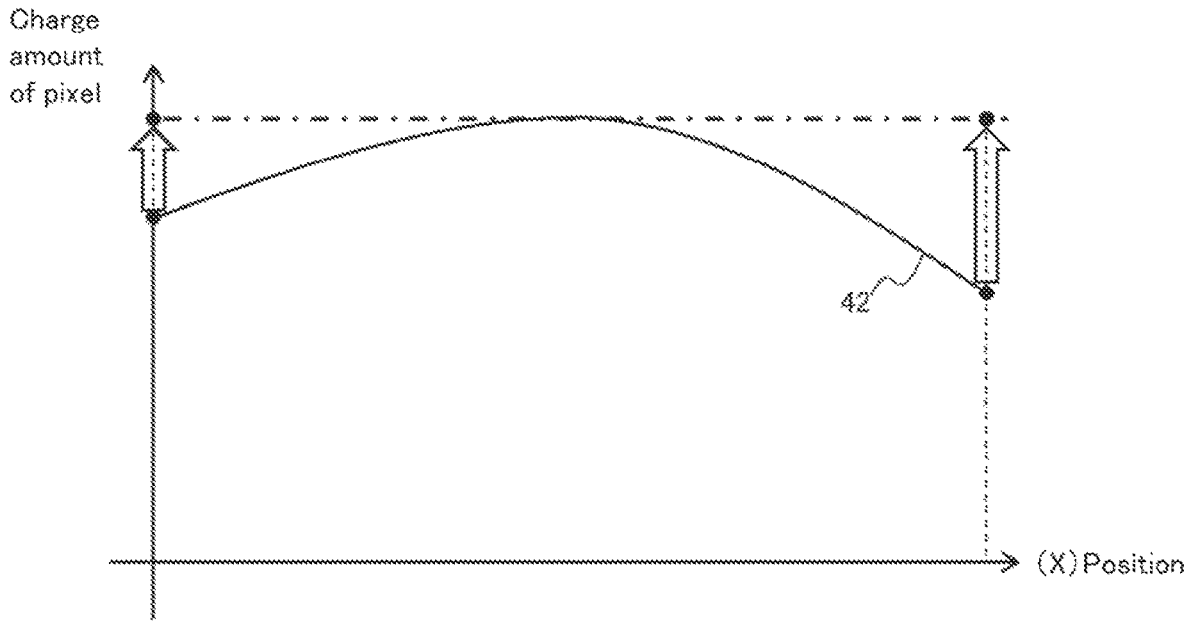
FIG. 9 is a diagram for describing setting of a gate slope by the display apparatus according to the first embodiment.

FIG. 9 is a diagram for describing the setting of a gate slope by the display apparatus 1. In the display apparatus 1 according to the present embodiment, various settings to the slope setting circuits 210 and 220 are performed for example during manufacturing development of the display apparatus 1.

In FIG. 9, a curve 42 shows a distribution of the charge amounts among the pixels. The curve 42 is asymmetrical from left to right in the X direction of the display panel 10 (FIG. 1) in the same manner as FIG. 7B. In the slope setting circuits 210 and 220 (FIG. 6) according to the present embodiment, the resistance values of the two resistors 215 and 225 can be set to different values so as to give a time constant according to the curve 42 which is asymmetrical from left to right. For example, the resistance values of the two resistors 215 and 225 are set so that the charge amount of the pixel 3 nearest to the left end of a gate line GL and the charge amount of the pixel 3 nearest the right end of the gate line GL are equal.

In the setting of the gate slope, the charge voltage of when a specific luminance (maximum luminance, for example) is displayed in each pixel 3 in the display apparatus 1 for example can be used as the charge amount of a reference pixel. Settings may be performed not only of the resistance values of the resistors 215 and 225, but also of the capacity values of the capacitors 216 and 226, the slope width T2, or the like. A setting value of the slope width T2 is written to the memory 24 for example, so as to be referred to when the controller 23 generates the control signal So.

In a mass-production stage of the display apparatus 1, the display panel 10 is assumed to be manufactured with different characteristics according to for example the position of the display panel 10 in mother glass. For example, the display panel 10 is assumed to have characteristics reversed left to right from the curve 42 due to the left or right sides of the display panel 10 being positioned near the center of the mother glass, or the like. With respect to such a display panel 10, equalization of the charge amount can be efficiently performed by replacing the resistors 215 and 225 selected by the selection switches 214 and 224 of the slope setting circuits 210 and 220.

The slope setting circuits 210 to 220 are also not limited to having the two resistors 215 and 225. Three or more resistors may be incorporated and selected by the selection switches 214 and 224. Respective resistance values may be set based on for example the expected characteristics of the display panel 10 according to various positions of the display panel 10 in the mother glass. Information about resistors selected for each display panel 10 is for example written to the memory 24 such that the controller 23 refers to the information when generating the control signals S1 and S2.

Some of a large number of mass-produced display apparatuses 1 may have characteristics which are symmetrical from left to right. Therefore, the same resistors may be selectable by the independent selection switches 214 and 224 of the slope setting circuits 210 and 220.

3. Summary

As described above, the display apparatus 1 according to the present embodiment includes the display panel 10, the first gate drive circuit 11, the second gate drive circuit 12, the first gate slope forming section 21, and the second gate slope forming section 22. In the display panel 10, the pixels 3 are arranged in a matrix, and the gate lines GL which select pixel groups aligned in the row (X) direction of the matrix are arranged side by side in the column (Y) direction of the matrix. The first gate drive circuit 11 supplies the first gate drive signal G1 to each gate line GL from one end of the gate line GL. The second gate drive circuit 12 supplies the second gate drive signal G2 to each gate line GL from the opposite end of the gate line GL. The first gate slope forming section 21 forms the gate slope which is a falling slope in the signal waveform of the first gate drive signal G1. The second gate slope forming section 22 forms the gate slope of the second gate drive signal G2 independently of the first gate slope forming section 21.

According to the above display apparatus 1, the gate slopes of the first and second gate drive signals G1 and G2 are formed independently by the first and second gate slope forming sections 21 and 22. Thus, display unevenness can be reduced in the display apparatus 1 in which the gate lines GL are driven from both ends thereof.

According to the present embodiment, setting values of the respective gate slopes of the first and second gate drive signals G1 and G2 are set individually such that the charge amount of the pixel nearest one end of a pixel group connected to a gate line GL is equal to the charge amount of the pixel nearest the opposite end of the pixel group. Thus, the charge amounts of a pixel group that is asymmetrically uneven from left to right in the display panel 10 can be equalized, and display unevenness can be reduced with high precision.

Also according to the present embodiment, the first gate slope forming section 21 includes the level shifter 211, The second gate slope forming section 22 includes the level shifter 221 separately from the first gate slope forming section 21. Instead of the level shifters 211 and 221, the first gate slope forming section or the second gate slope forming section may include a voltage source by for example integrating the slope setting circuits 210 and 220 with the voltage source which generates the gate-on voltage VGH. Thus, the first and second gate slope forming sections 21 and 22 which generate gate slopes independently can be realized.

Also according to the present embodiment, the first and second gate drive circuits 11 and 12 are integrated with the display panel 10, constituting a GIP-type display panel. According to the display apparatus 1, display unevenness caused by characteristic unevenness of the GIP-type display panel 10 can be reduced.

Also according to the present embodiment, the first and second gate slope forming sections 21 and 22 include the slope setting circuits 210 and 220 as holding sections which hold the various setting values of the gate slopes. The setting values (resistance values, for example) of the gate slopes in the slope setting circuits 210 and 220 may be a plurality of setting values according to the characteristics of the display panel 10.

Also according to the present embodiment, the slope setting circuits 210 and 220 serving as holding sections include the selection switches 214 and 224 and the resistors 215 and 225. Instead of the selection switches 214 and 224 and the resistors 715 and 225, a variable resistor, a variable voltage source, or a plurality of voltage sources may be used as holding sections in the display apparatus 1. The memory 24 can also be made to function as a holding section by storing various information indicating the setting values of the gate slopes in the memory 24.

Second Embodiment

In the first embodiment, the first and second gate slope forming sections 21 and 22 form gate slopes independently using the slope setting circuits 210 and 220 capable of selecting resistance values. A slope setting circuit for generating gate slopes independently can be realized by various circuit configurations. The following describes an example in which a slope setting circuit is configured by setting a voltage value according to a second embodiment.

Figure 10:
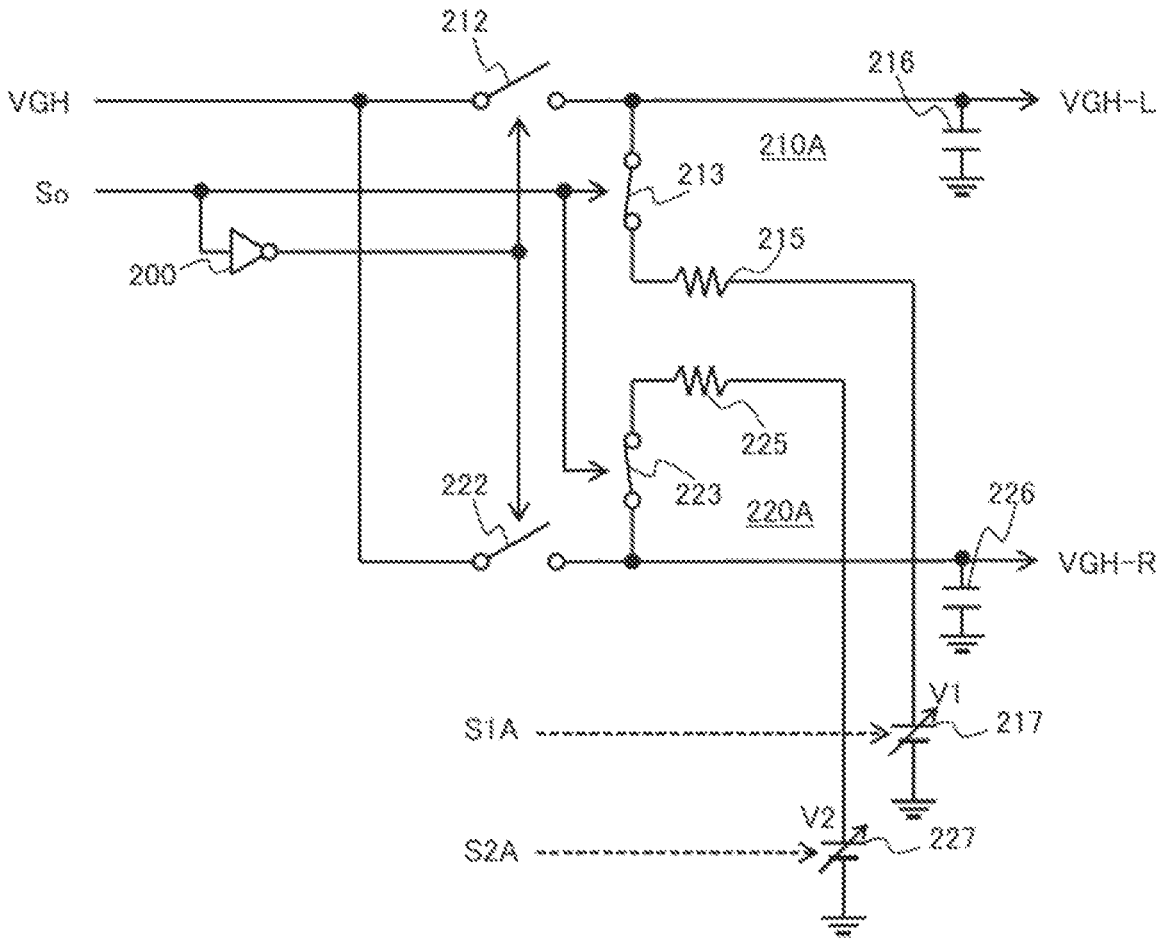
FIG. 10 is a circuit diagram illustrating a slope setting circuit according to a second embodiment.

FIG. 10 is a circuit diagram illustrating slope setting circuits 210A and 220A according to the second embodiment. The slope setting circuits 210A and 220A according to the present embodiment include variable voltage sources 217 and 227 instead of the selection switches 214 and 224 of the slope setting circuits 210 and 220 in FIG. 6.

The variable voltage sources 217 and 227 apply first and second setting voltages V1 and V2 to one end of the resistor 215 and one end of the resistor 225, respectively. An opposite end of the resistor 215 and an opposite end of the resistor 225 are connected to the discharge switches 213 and 223, respectively. According to the present embodiment, the voltage values of the first and second setting voltages V1 and V2 are controlled at voltage values preset in the memory 24, for example, using control signals S1A and S2A from the controller 23.

Figure 11:
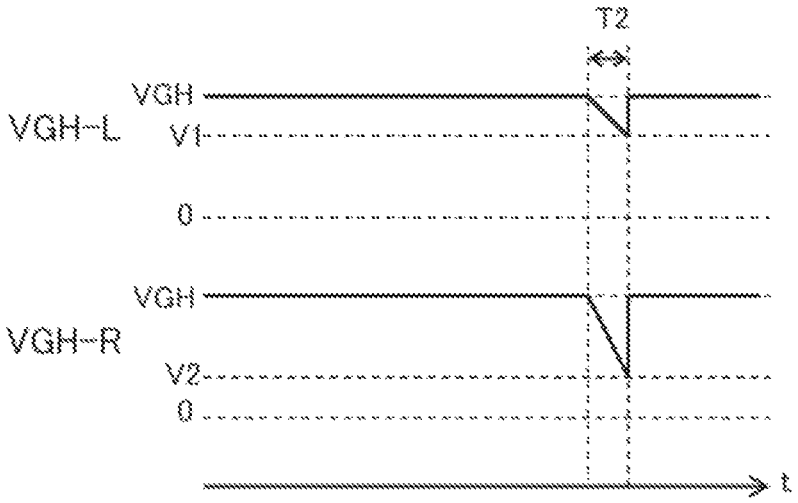
FIG. 11 is a timing diagram of various signals illustrating operation timing of a display apparatus according to the second embodiment.

VGH-L and in FIG. 11 illustrate the generation timing of the first and second gate slope voltages VGH-L and VGH-R by the respective slope setting circuits 210A and 220A according to the present embodiment.

According to the slope setting circuits 210A and 220A in the present embodiment, a voltage at an end of the fall in the slope width T2 in the first gate slope voltage VGH-L is controlled so as to become the first setting voltage V1, as illustrated in FIG. 11. A voltage at an end of the fall in the second gate slope voltage VGH-R is controlled so as to become the second setting voltage V2, which is different from the first setting voltage V1, as illustrated in FIG. 11. Therefore, the inclination degrees of the gate slopes formed by the first and second gate slope forming sections 21 and 22 including the slope setting circuits 210A and 220A are set independently by the first and second setting voltages V1 and V2.

For example, a plurality of setting values are prepared in advance for the voltage values of the setting voltages V1 and V2 and written to the memory 24 at the time of manufacturing or the like. Thus, a plurality of setting values can be provided for the setting voltages V1 and V2 without enlarging a circuit surface area.

Figure 12:
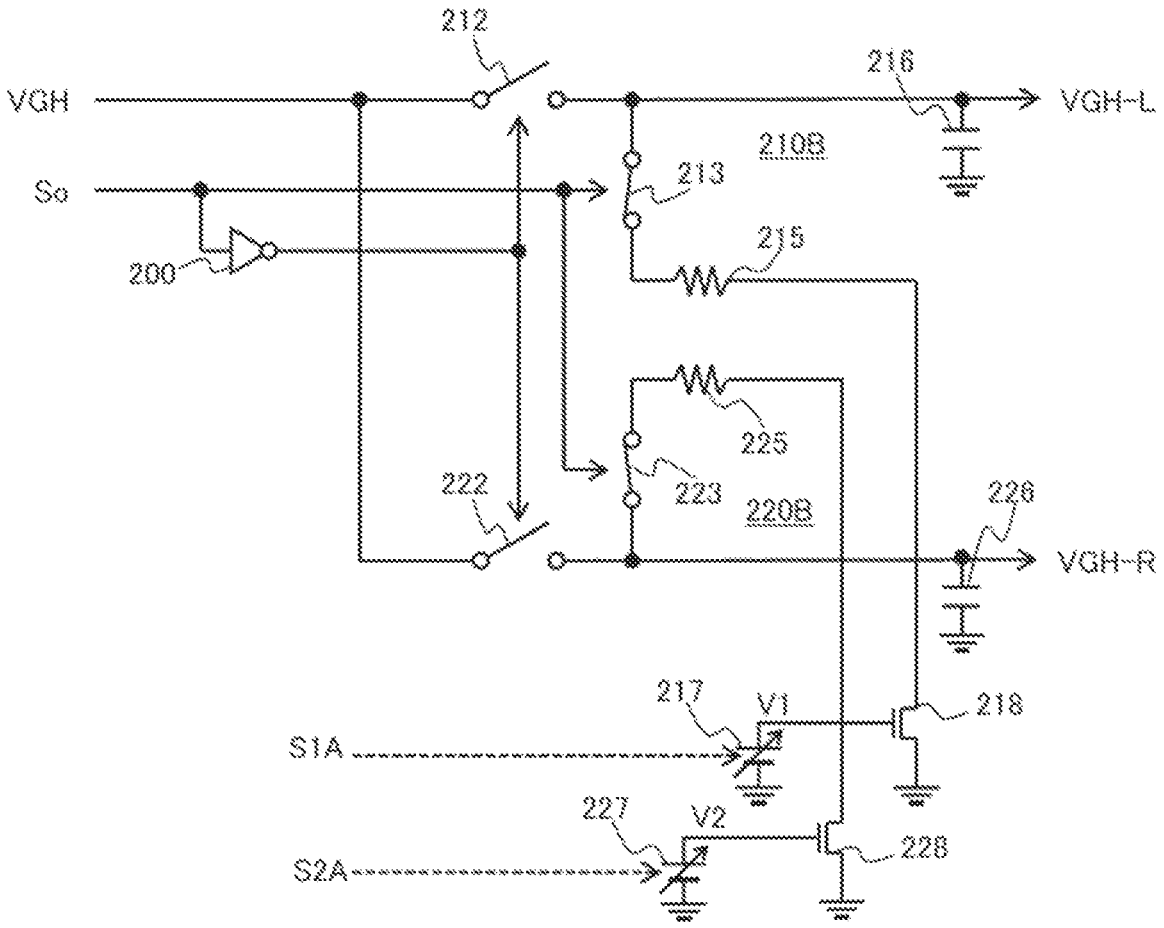
FIG. 12 is a circuit diagram illustrating a slope setting circuit according to a first variation of the second embodiment.

FIG. 12 is a circuit diagram illustrating slope setting circuits 210B and 220B of a first variation of the second embodiment. The slope setting circuits 210B and 220B of the present variation include MOS transistors 218 and 228 in addition to the configurations of the slope setting circuits 210A and 220A (FIG. 10) according to the second embodiment.

The MOS transistors 218 and 228 are connected to the resistors 215 and 225 and grounded. The first and second setting voltages V1 and V2 are applied by the respective variable voltage sources 217 and 227 to the gates of the MOS transistors 218 and 228.

According to the slope setting circuits 210B and 220B of the present variation, on resistance of the MOS transistors 218 and 228 is changed by controlling the first and second setting voltages V1 and V2 with control signals S1A and S2A. Thus, the gate slopes can also be formed independently by the first and second gate slope forming sections 21 and 22 in the present circuit configuration.

Figure 13:
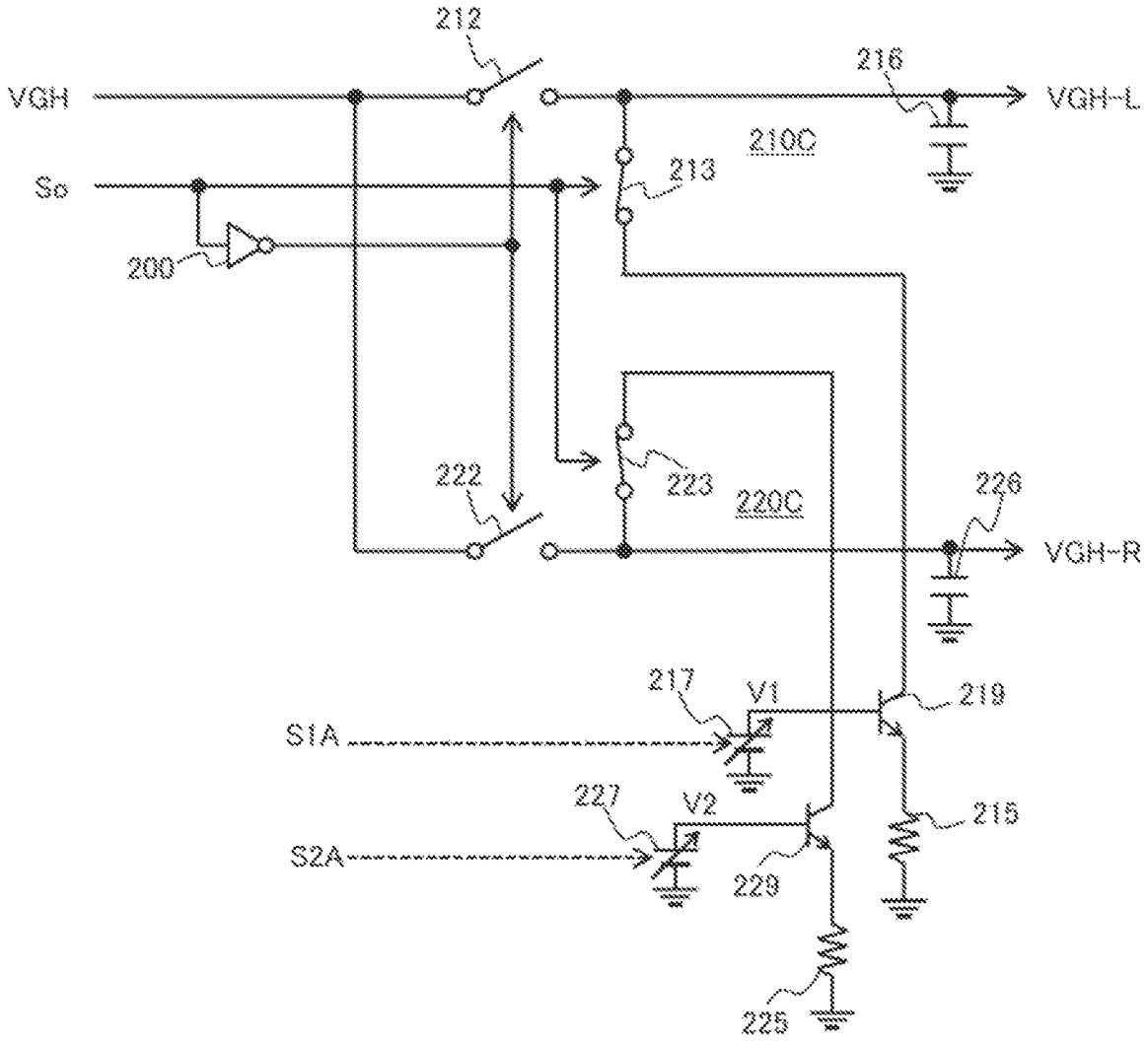
FIG. 13 is a circuit diagram illustrating a slope setting circuit according to a second variation of the second embodiment.

FIG. 13 is a circuit diagram illustrating slope setting circuits 210C and 220C of a second variation of the second embodiment. The slope setting circuits 210C and 220C of the present variation include bipolar transistors 219 and 229 instead of the MOS transistors 218 and 228 of the slope setting circuits 210B and 220B of the first variation.

The bipolar transistors 219 and 229 are connected in between the discharge switches 213 and 223 and the resistors 215 and 225. The first and second setting voltages V1 and V2 are applied by the respective variable voltage sources 217 and 227 to the bases of the bipolar transistors 219 and 229.

The gate slopes can also be formed independently by the first and second gate slope forming sections 21 and 22 through electric current control of the bipolar transistors 219 and 229 according to the first and second setting voltages V1 and V2 in the present circuit configuration.

Additional Embodiment

In each of the above embodiments, the gate slopes formed respectively by the first and second gate slope forming sections 21 and 22 have the same slope width T2. However, the slope width may vary between the gate slopes. The following describes such an example with reference to FIG. 14.

Figure 14:
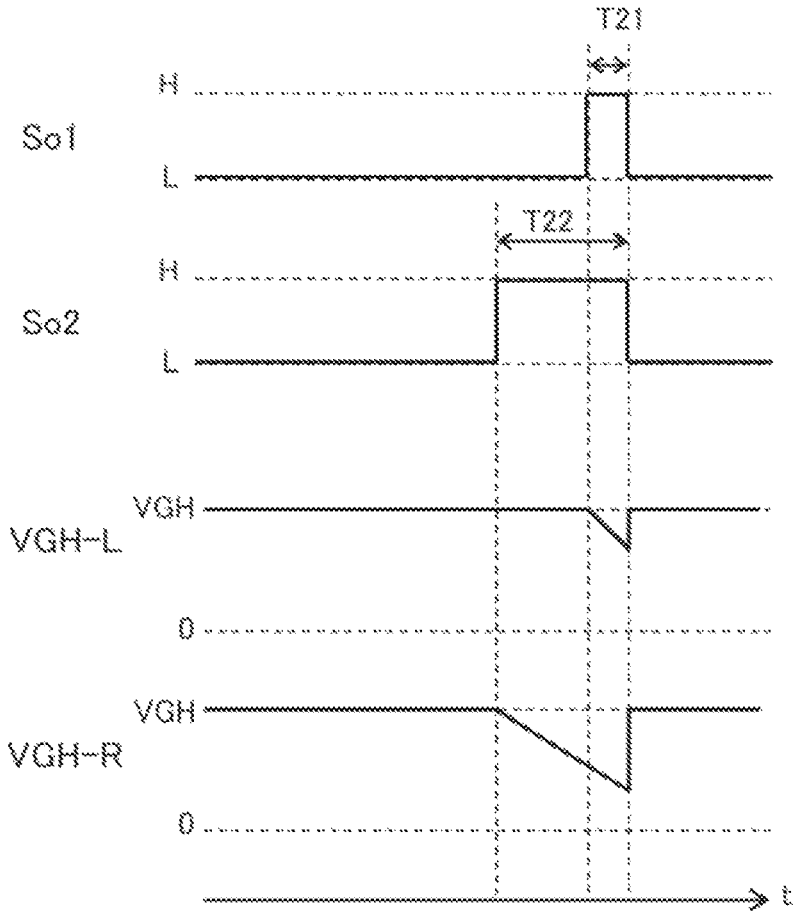
FIG. 14 is a timing diagram illustrating a variation of the operation timing of the first and second gate slope forming sections.

So1 in FIG. 14 illustrates a control timing of a control signal So1 for the first gate slope forming section 21. So2 in FIG. 14 illustrates a control timing of a control signal So2 for the second gate slope forming section 22. VGH-L and VGH-R in FIG. 14 respectively illustrate generation timing of the first and second gate slope voltages VGH-L and VGH-R.

According to the present variation, slope widths T21 and T22 of the first and second gate slope forming sections 21 are set separately using the two control signals So1 and So2 instead of the control signal which sets the slope width T2 in each of the above embodiments. Setting values of the first and second slope widths T21 and T22 are prestored in the memory 24.

The controller 23 refers to the first slope width T21 stored in the memory 24 to generate the control signal So1 as illustrated in FIG. 14 and outputs the control signal So1 to the slope setting circuit 210 of the first gate slope forming section 21. Thus, the first gate slope voltage VGH-L that falls within the first slope width T21 is generated as illustrated in FIG. 14.

The controller 23 also generates the control signal So2 based on the second slope width T22 as illustrated in FIG. 14 and outputs the control signal So2 to the slope setting circuit 220 of the second gate slope forming section 22. Thus, the second gate slope voltage VGH-R that falls within the second slope width T22 is generated as illustrated in FIG. 14.

The first and second gate slope forming sections 21 and 22 can form gate slopes with the respective first and second slope widths T21 and T22 through the first and second gate slope voltages VGH-L and VGH-R generated as above.

According to the above first embodiment, the slope setting circuits 210 and 220 are provided between the power supply section 20 and the level shifters 211 and 221 in the first and second gate slope forming sections 21 and 22 (refer to FIGS. 3 and 5), but the first and second gate slope forming sections according to the present invention are not limited as such. The following describes a variation of the first and second gate slope forming sections with reference to FIG. 15.

Figure 15:
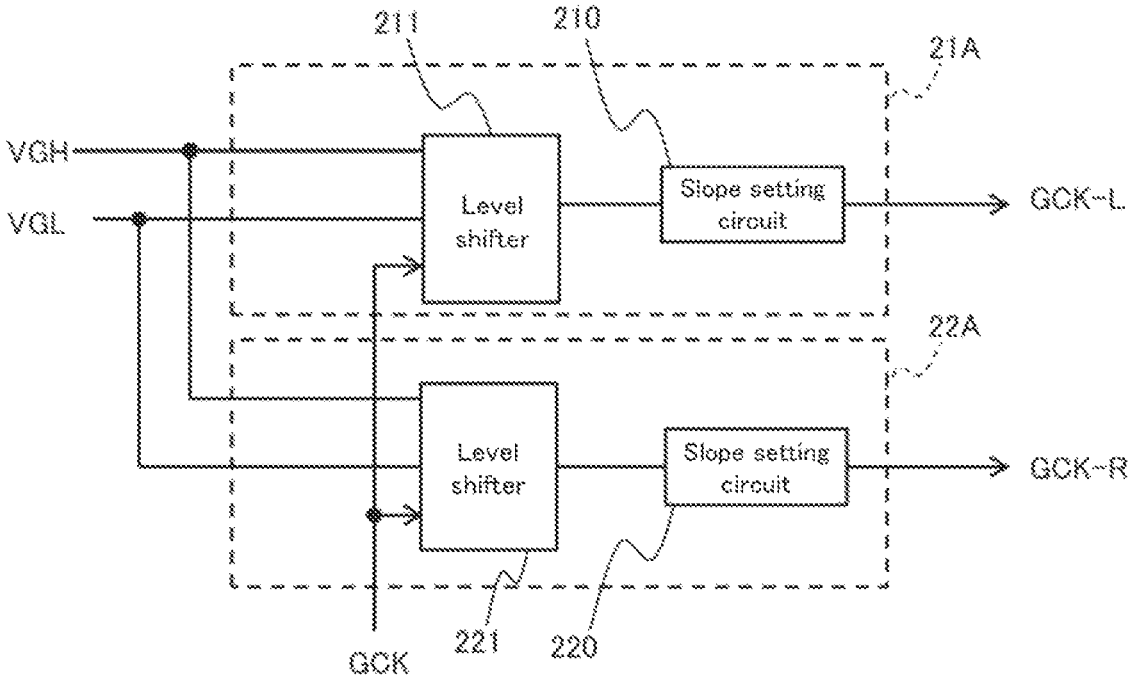
FIG. 15 is a block diagram illustrating a configuration of a variation of the first and second gate slope forming sections.

FIG. 15 illustrates a configuration of first and second gate slope forming sections 21A and 22A according to the variation.

In the first and second gate slope forming sections 21A and 22A according to the present variation, the slope setting circuits 210 and 220 are provided on an output side of the respective level shifters 211 and 221 as illustrated in FIG. 15. Therefore, the gate-on voltage VGH is input to each of the level shifters 211 and 221 of the first and second gate slope forming sections 21A and 22A without particular modulation.

The level shifters 211 and 221 increase the high level and the low level of the clock signal GCK respectively to the gate-on voltage VGH and the gate-off voltage VGL, and output the clock signal GCK to the slope setting circuits 210 and 220. The slope setting circuits 210 and 220 set the respective gate slopes and output the first and second gate signals GCK-L and GCK-R by controlling the control signal So in the same manner as the first embodiment.

Also according to the above first embodiment, the resistors 215 and 225 are selected to modulate the resistance values, but the present invention is not limited as such. For example, the capacity values may be changed using a plurality of capacitors 216 and 226.

Also according to each of the above embodiments, setting of the gate slopes is performed using the various control signals S1 to S2A based on the information stored in the memory 24, hut the present invention is not limited as such. For example, the gate slopes may be physically fixed using a fused circuit or the like.

Additionally, each of the above embodiments is described using an example in which the display apparatus 1 is of GIP type. However, the present invention is not limited as such. The principles of the present invention can also be applied whenever display unevenness becomes apparent upon setting gate slopes of the same waveform on both ends due to for example increasing speed or increasing surface area, even in other types of display apparatus.

Furthermore, each of the above embodiments is described using an example in which the first and second gate drive circuits 11 and 12 are provided on the left and right sides of the display apparatus 1, but positioning of the first and second gate drive circuits 11 and 12 is not particularly limited to left and right. The present invention can be applied whenever gate drive circuits are provided at either end of a gate line.

The invention claimed is:

1. A display apparatus comprising:

a display panel in which a plurality of pixels are arranged in a matrix, and a plurality of gate lines which each select a pixel group of pixels aligned in a row direction of the matrix are arranged side by side in a column direction of the matrix;

a first gate drive circuit configured to supply a first gate drive signal to each of the plurality of gate lines from one end of each of the plurality of gate lines;

a second gate drive circuit configured to supply a second gate drive signal to each of the plurality of gate lines from an opposite end of each of the plurality of gate lines;

a first gate slope forming section configured to form, based on a first setting value, a gate slope which is a falling slope in a signal waveform of the first gate drive signal before the first gate drive circuit supplies the first gate drive signal; and a second gate slope forming section configured to form, based on a second setting value, a gate slope which is a falling slope in a signal waveform of the second gate drive signal independently from the first gate slope forming section before the second gate drive circuit supplies the second gate drive signal.

2. The display apparatus according to claim 1, wherein setting values of the respective gate slopes of the first and second gate drive signals are individually set so that a charge amount of a pixel nearest the one end among the pixel group is equal to a charge amount of a pixel nearest the opposite end among the pixel group.

3. The display apparatus according to claim 1, wherein the first gate slope forming section includes at least one of a level shifter and a voltage source, and the second gate slope forming section includes at least one of a level shifter and a voltage source separately from the first gate slope forming section.

4. The display apparatus according to claim 1, wherein the first and second gate drive circuits are integrated with the display panel, constituting a GIP-type display panel.

5. The display apparatus according to claim 1, wherein the first and second gate slope forming sections include a holding section configured to hold setting values of a plurality of gate slopes according to characteristics of the display panel.

6. The display apparatus according to claim 5, wherein the holding section includes at least one of memory, a switch, a resistor, and a voltage source.

7. The display apparatus according to claim 1, wherein the first and second setting values differ from each other.

8. The display apparatus according to claim 1, wherein the first and second setting values are setting values related to either or both of a slope width of the gate slope and an inclination of the gate slope.

9. The display apparatus according to claim 1, wherein the first and second gate slope forming sections form the gate slopes in the first and second gate drive signals based on the same clock signal.

10. The display apparatus according to claim 1, wherein the first and second gate slope forming sections include a holding section configured to hold a plurality of setting values of the gate slopes selectable as the first and second setting values.

11. The display apparatus according to claim 10, wherein the first and second gate slope forming sections hold the plurality of setting values of the gate slopes as interchangeable with each other.

* * * * *